United States Patent [19]

Anscher

[11] Patent Number: 4,677,711

[45] Date of Patent: Jul. 7, 1987

[54] REVERSIBLE BUCKLE

[75] Inventor: Joseph Anscher, Huntington Bay, N.Y.

[73] Assignee: National Molding Corporation, Farmingdale, N.Y.

[21] Appl. No.: 841,281

[22] Filed: Mar. 19, 1986

[51] Int. Cl.[4] ..... A44B 11/04

[52] U.S. Cl. ..... 24/200; 24/193; 24/196

[58] Field of Search ..... 24/169, 193, 196, 200, 24/265 CD, 265 AL, 616

[56] References Cited

U.S. PATENT DOCUMENTS

| | | | |
|---|---|---|---|
| 2,066,914 | 1/1937 | Staples | 24/200 |
| 2,754,560 | 7/1956 | Warner et al. | 24/196 |
| 3,169,291 | 2/1965 | Stacherl | 24/196 |
| 3,376,613 | 4/1968 | Lindblad | 24/200 |
| 3,407,451 | 10/1968 | Dewey et al. | 24/196 |
| 3,760,466 | 9/1973 | Leblanc | 24/200 |
| 3,858,279 | 1/1975 | Brattstrom | 24/200 |
| 4,171,555 | 10/1979 | Bakker et al. | 24/200 |
| 4,571,783 | 2/1986 | Kasai | 24/193 |

FOREIGN PATENT DOCUMENTS

| | | | |
|---|---|---|---|
| 504066 | 7/1951 | Belgium | 24/200 |
| 857700 | 12/1952 | Fed. Rep. of Germany | 24/200 |
| 2451175 | 11/1980 | France | 24/616 |

*Primary Examiner*—Victor N. Sakran

*Attorney, Agent, or Firm*—Kenyon & Kenyon

[57] ABSTRACT

A reversible buckle has a body with two side pieces that define the buckle's upper and lower faces, means for securing the buckle to a workpiece, and means for adjustably securing a strap to the buckle. The adjustably securing means includes substantially parallel first and second cross-members. The first cross-member has a substantially convex region and the second cross-member has a substantially concave region disposed substantially opposite the convex region so that the concave and convex regions are capable of cooperatively engaging and adjustably securing a strap threaded therethrough from the lower face or from the upper face.

20 Claims, 8 Drawing Figures

REVERSIBLE BUCKLE

This invention relates generally to fasteners, and more particularly to buckle-type fasteners adapted to secure adjustably a strap or the like.

BACKGROUND OF THE INVENTION

Adjustable fasteners have many uses in leisure, camping, sports, and safety products, where it is desired that a strap or belt be adjustably secured. Examples include seat belts for automobiles, shoulder straps for backpacks or luggage, and the adjustable straps for life jackets. For both convenience in the manufacture of articles employing adjustable fasteners, and for ease in use of such articles, it is desirable that the fasteners be reversible, so that the strap or belt to be adjustably secured can be threaded through the fastener from the fastener's top face or from its bottom face. Where a reversible fastener is employed in, e.g., a piece of luggage, it is not necessary to ensure during the manufacturing of the luggage that the fastener is threaded onto the straps from the proper orientation, because threading is correct from either face. Similarly, in the use of articles employing adjustable fasteners, the user can thread a strap through a fastener without having to examine the fastener to ensure that the strap is being threaded through the correct fastener face. This advantage is particularly important in safety applications, for example, with a life jacket, where the user could be agitated and the jacket must be fastened securely and quickly.

While a large number of fasteners are well known, reversible threading designs have been avoided due to the problem of providing economical fasteners that are suitable for mass production and that sufficiently engage a strap or web threaded therethrough to provide a tight, non-slip attachment that is easily released.

In light of the foregoing, it is an object of the invention to provide a reversible adjustable fastener.

It is a further object of the invention to provide a reversible fastener that tightly engages a strap threaded therethrough in a tight non-slip attachment that is easily released.

It is a further object of the invention to provide an adjustable fastener that improves the convenience of manufacture of articles employing such fasteners.

It is yet a further object of the invention to provide an adjustable fastener that improves the ease in use of articles employing such fasteners.

SUMMARY OF THE INVENTION

These and other objects and advantages are achieved by providing an adjustable fastener having a body with two side pieces that define the fastener's upper and lower faces, means for securing the fastener to a workpiece, and means for adjustably securing a strap to the fastener. The adjustably securing means includes substantially parallel first and second cross-members. The first cross-member has a substantially convex region and the second cross-member has a substantially concave region disposed substantially opposite the convex region so that the concave and convex regions are capable of cooperatively engaging and adjustably securing a strap threaded therethrough from the lower face or from the upper face.

In preferred embodiments: the first and second cross-members are substantially bilaterally symmetric about a longitudinal central plane disposed parallel to the upper and lower faces; the convex region of the first cross-member is substantially V-shaped, made up of two surfaces extending from the central plane to the top and bottom face, respectively, forming an edge capable of engaging a strap and defining an angle of less than about 180° and more preferably less than about 120°, most preferably about 100°; the concave region is V-shaped, extends between two flat surfaces disposed respectively on the planes of the upper and lower faces and forms edges where it abuts the two surfaces that are capable of engaging a strap defining included angles less than about 90°, most preferably about 55°. The fastener may be a detachable two-piece buckle-type fastener.

DESCRIPTION OF THE PREFERRED EMBODIMENT

Figure 1:
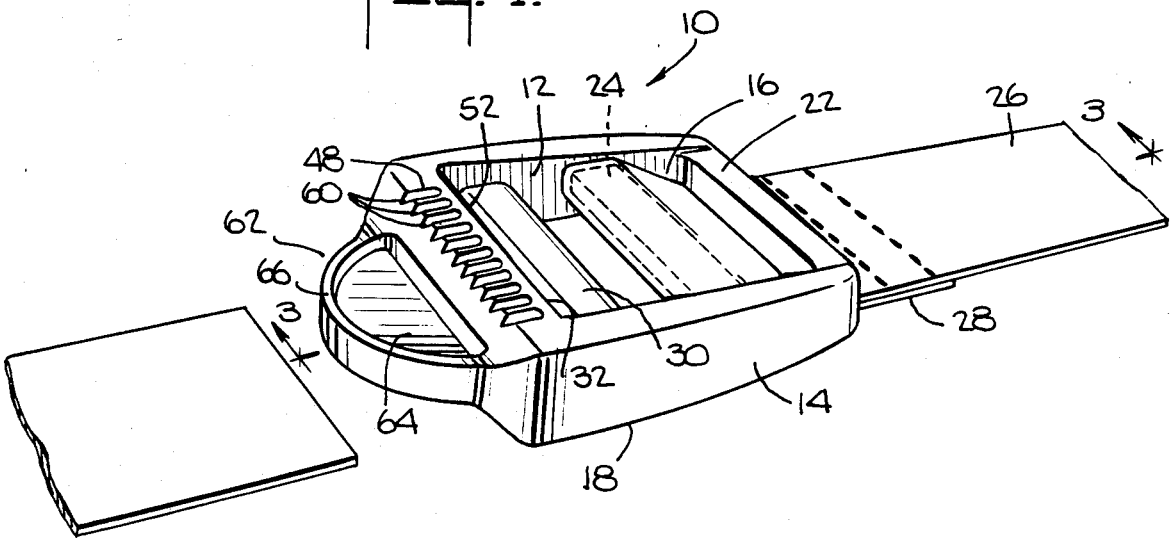
FIG. 1 is a perspective view of a buckle according to the invention, showing a strap fixedly secured to one end of the buckle.

Like reference numbers denote like parts throughout the drawings. Referring to FIG. 1, there is shown a buckletype fastener, generally identified by reference number 10. Buckle 10 has two side pieces 12 and 14 that define the sides of the buckle and also the top face 16 and bottom face 18. Side pieces 12 and 14 are symmetrical with respect to each other and each is symmetrical about a longitudinal plane 20 that passes through the middle of the buckle. Extending between side pieces 12 and 14 are transverse bars 22 and 24, each of which is rectangular in cross section with rounded edges. Bars 22 and 24 are adapted for fixedly securing strap or belt 26 to buckle 10. It will be appreciated that the cross-sectional shape of bars 22 and 24 is not critical to the invention and virtually any shape will perform the desired function. For the purposes of this application, the term strap will be used broadly to denote any strap or web like material that is suitable to be fastened by an adjustable buckle, including but not limited to woven cloth or synthetic belts, cord, and rope.

Figure 3:
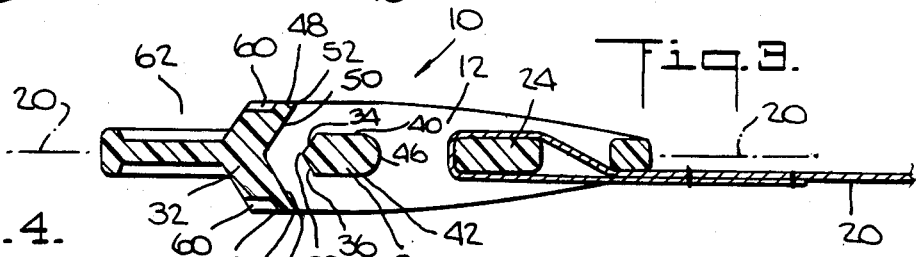
FIG. 3 is a cross-section of the buckle of FIG. 1, along line 3—3 of FIG. 1.
Figure 4:
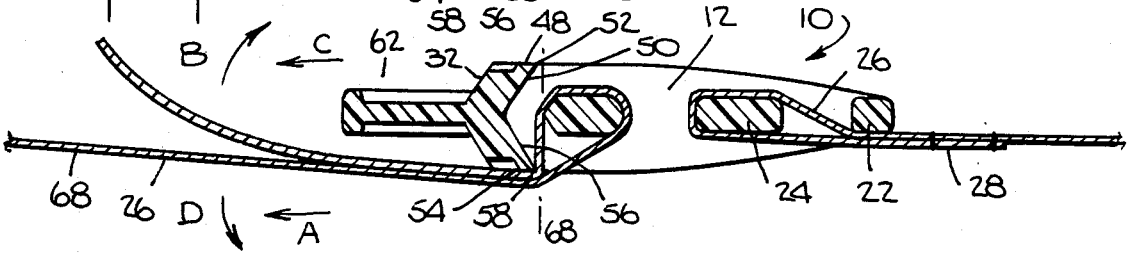
FIG. 4 is a cross-section of the buckle of FIG. 2, along line 4—4 of FIG. 2.
Figure 5:
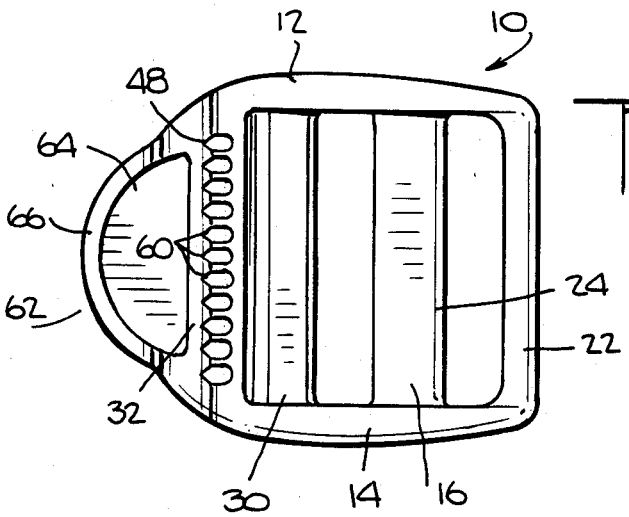
FIG. 5 is a top plan view of the buckle of FIG. 1.
Figure 7:
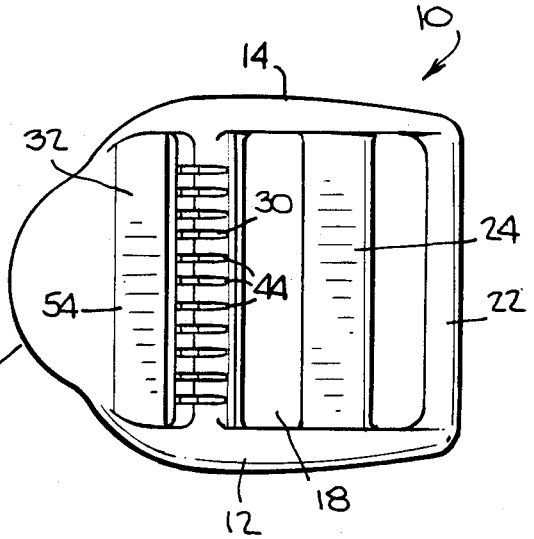
FIG. 7 is a bottom plan view of the buckle of FIG. 1.
Figure 8:
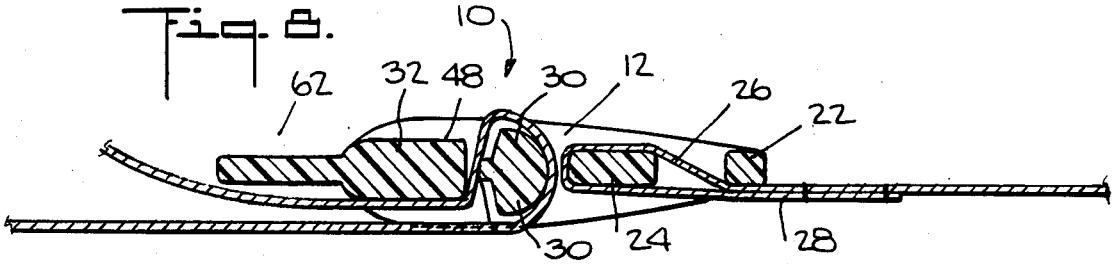
FIG. 8 is a cross-section of an alternative embodiment of the invention.

Also extending between side pieces 12 and 14 are transverse bars 30 and 32, centrally disposed and symmetric about central plane 20, as best seen in FIGS. 3 and 4. Bars 30 and 32 make up the adjustable strap securing means of the buckle. Bar 30 has a generally convex V-shaped region made up of surfaces 34 and 36 and generally facing bar 32. Surface 34 extends from central plane 20 toward upper face 16, and surface 36 extends from central plane 20 toward lower face 18. Surfaces 34 and 36 are symmetric about central plane 20 and define an included angle of about 100°. Surfaces 34 and 36 form a relatively sharp edge 38 at their juncture. At their opposite edges, surfaces 34 and 36 abut flat surfaces 40 and 42, respectively. Surfaces 40 and 42 are substantially parallel to central plane 20 and extend from their juncture with surfaces 34 and 36 away from bar 32. As shown in FIG. 7, grooves 44 extend from edge 38 along surfaces 36 and 42. Similar grooves 44 extend from edge 38 along surfaces 34 and 40. Bar 30 has a fifth surface 46 that is rounded and abuts surfaces 40 and 42. Of course the cross-section of bar 30 can be virtually any shape as long as structure equivalent to relatively sharp edge 38 is provided to frictionally engage the strap, e.g., bar 30 could be triangular.

Bar 32 has a generally V-shaped concave region made up of surfaces 50 and 56. This concave region is symmetric about central plane 20, extending from upper face 16 to lower face 18 and disposed opposite the convex region of bar 30. At the upper face 16 and substantially on the plane of upper face 16, bar 32 has a top surface 48. Adjacent to surface 48 and extending in the direction of central plane 20 is acutely disposed surface 50. At their juncture, surfaces 48 and 50 form edge 52. Surfaces 48 and 50 form an included angle of about 55°. At lower face 16, substantially on the plane of lower face 18, and corresponding to surface 48, is a bottom surface 54 of bar 32. Adjacent to bottom surface 54 and extending in the direction of central plane 20 is acutely disposed surface 56. At their juncture, acutely disposed surface 56 and bottom surface 54 form edge 58 and define an included angle of about 55°. As is apparent, surface 56 corresponds to surface 50, and edge 58 corresponds to edge 52. Along surfaces 48 and 54 are grooves 60. As can best be seen in FIG. 3, grooves 60 do not extend to edges 52 or 58, but extend backwardly away from bar 30 from intermediate points on surfaces 48 and 54. Bar 32 also includes handle portion 62 which extends back from the central portion of bar 32 in plane 20. Handle portion 62 is adapted to be grasped by a user and includes both flat area 64 and raised edge 66.

Bars 30 and 32 are in spaced relation, arranged so that edge 38 opposes edges 52 and 58. As shown in FIG. 4, edge 38 is on the opposite side of plane 20 from edges 52 and 58. Plane 20 is normal to faces 16 and 18 and to central plane 20, and parallel to transverse bars 30 and 32. Edge 38 is spaced from edges 52 and 58 along a line perpendicular to plane 20 at a distance not greater than the approximate thickness of a strap to be adjustably secured by the buckle.

In operation, one end 28 of strap 26 is looped around bar 24 and then sewn onto the strap as shown in FIGS. 1–4. Alternatively, the end 28 of strap 26 is fixedly attached to itself through other means, for example glue, staples, or rivets. In certain applications it may be desirable to removably attach end 28 of strap 26 to buckle 10, such as, for example, with Velcro®.

Figure 2:
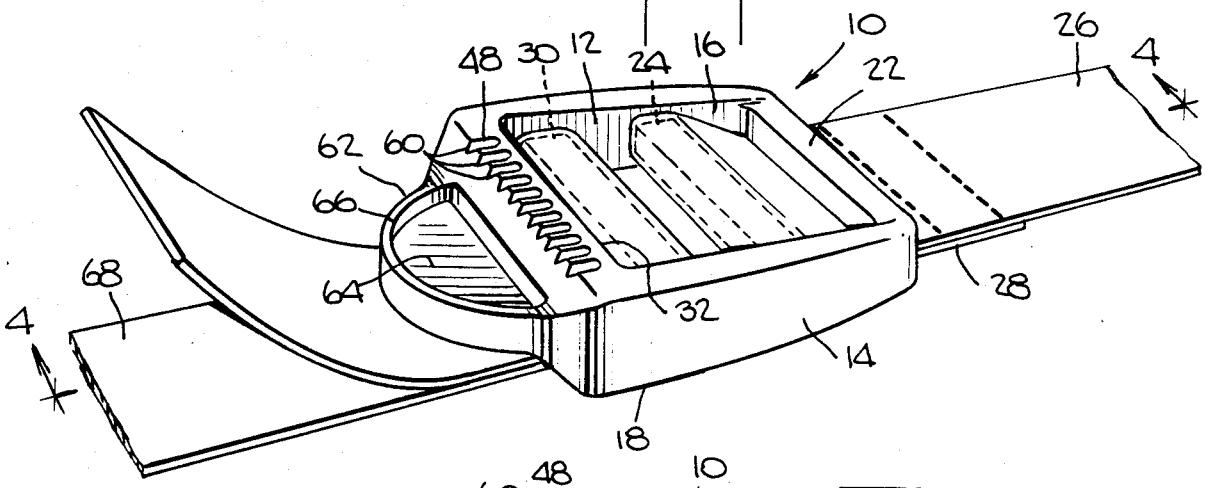
FIG. 2 is a perspective view of the buckle in FIG. 1, showing a strap fixedly secured to one end of the buckle and a strap adjustably secured to the other end of the buckle.

The opposite end of the strap, or alternatively an end of a second strap, can be adjustably secured to the buckle by threading the strap through the buckle in either of two ways. Thus, as shown in FIGS. 2 and 4, the strap can be fed from the bottom face 18 between bars 24 and 30, over bar 30, and then between bars 30 and 32 and out the bottom face again. Force exerted on the portion 68 of strap 26 in the direction of arrow A will ensure a tight non-slip attachment and secure strap 26 from slipping with respect to buckle 10. Specifically, surface 34 and edge 38 of bar 30 engage strap 26 in cooperation with surface 54 and edge 58 of bar 32 to prevent strap 26 from slipping as long as force is exerted on strap 26 in the direction of arrow A. When strap 26 is thus engaged, the portion of the strap extending between edges 38 and 58 is inclined in the direction of surface 56. Grooves 44 on surfaces 40 and 34, as well as grooves 60 on surface 54 guide strap 26 along these surfaces and prevent the strap from bunching up if, for example, the buckle is twisted. Strap 26 can be adjusted conveniently or released by grasping the buckle 10 by its handle 62 and moving the buckle in the direction of arrow B. Alternatively, strap 26 can be adjusted on buckle 10 by slackening the tension that is exerted on portion 68 of strap 26 in the direction of arrow A. The curved surface 46 of bar 30 facilitates adjustment of strap 26 by allowing the strap to slide easily across bar 30 when the strap is not secured through engagement with edges 38 and 42.

Analogously, strap 26 can be fed from the top face 16 of buckle 10 between bars 24 and 30, under bar 30, and then between bars 30 and 32 and out the top face again. According to this arrangement, force exerted on the portion 68 of strap 26 in the direction of arrow C will ensure a tight non-slip attachment and secure strap 26 from slipping with respect to buckle 10; specifically, surface 36 and edge 38 of bar 30 engage strap 26 in cooperation with surface 48 and edge 52 of bar 32. Strap 26 can be adjusted or removed by grasping buckle 10 by handle 64 and moving the buckle in the direction of arrow D. Or, the strap can be adjusted by releasing the tension on the strap. Thus it can be seen that the buckle of this invention is reversible with respect to its orientation to a cooperating strap it is intended to secure.

It will be appreciated by those skilled in the art that other embodiments are within the scope of this invention and the claims appended hereto. For example, bar 24, which serves to fixedly secure buckle 10 to one end of strap 26, can be replaced with any other suitable means for fixedly attaching a buckle to a strap. For that matter, the buckle need not be fixedly attached to a strap at all, but can for example, be directly attached to a piece of luggage with a hinge or the like.

The convex region of bar 30 need not be V-shaped, but can be curved and generally C-shaped. Similarly, the concave region of bar 32 need not be V-shaped, but can be C-shaped. A C-shaped concave region could be made up of a single curved surface, or of several surfaces, which could be flat or curved.

The buckle need not be symmetric about central plane 20. It may be desired, for example, that the relative angles, dimensions, and/or orientations of the cooperating strap engaging edges vary, so that a strap engaged by surfaces 36 and 48 will be secured more or less tightly than a strap engaged by surfaces 34 and 54. Thus an asymmetrical buckle of the invention would permit the user to select whether he/she desires the strap to be more or less firmly secured and accordingly to thread the strap through the buckle from the upper or lower face. In some applications it may be desirable that the strap sometimes be secured so that it will slip when a predetermined threshold level of force is exerted on the strap in the direction of arrow A, but at other times be more firmly secured. Such an asymmetrical buckle of the invention would be useful in, e.g., a sailboat.

In addition to the various surfaces described in the preferred embodiment, above, a buckle according to the invention can be provided with an additional surface at the juncture of surfaces 34 and 36 of bar 30 substantially normal to central plane 20. Buckle 10 can similarly be provided with an additional surface at the juncture of surfaces 54 and 56, substantially normal to surface 54, and/or with a surface at the juncture of surfaces 48 and 50 substantially normal to surface 48. The decision whether to provide the buckle with any or all of these additional surfaces will depend on the desired behavior of the strap when adjustably secured to the buckle, and whether wear of the strap on edges 38, 52, or 58 is an important consideration for the intended use of the buckle.

Figure 6:
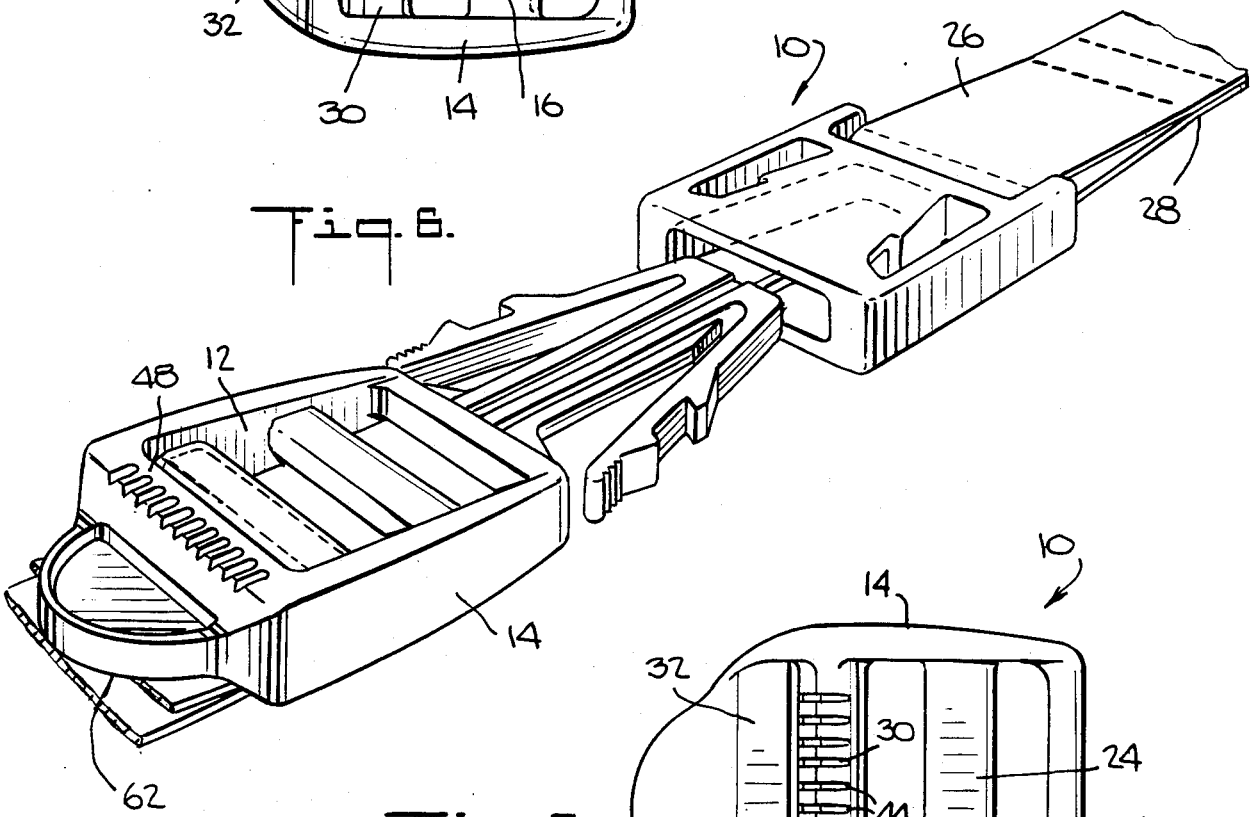
FIG. 6 is a perspective view of a two piece buckle according to the invention.

As shown in FIG. 6, the invention also contemplates a detachable two-piece type buckle having one piece fixedly secured to a strap, and the other piece of the buckle adjustably secured to a strap in the manner as described above. It will be appreciated that any appropriate mechanism may be used to buckle the two halves together, for example the buckle mechanism disclosed in copending application U.S. Ser. No. 811,895, filed Dec. 20, 1985 and assigned to the same assignee as the current invention, which is hereby incorporated herein by reference.

What is claimed is:

1. A reversible fastener comprising:

a body having two side members that define an upper face and lower face;

means for securing the fastener to a workpiece; and means for adjustably securing a strap to the fastener, said adjustably securing means comprising first and second substantially parallel cross-members disposed between and connecting common surfaces of said side members, said first and second cross-members being stationary within the body;

said first cross-member having a substantially convex region and said second cross-member having a substantially concave region disposed substantially opposite said convex region so that said regions are capable of cooperatively engaging and adjustably securing a strap threaded therethrough from said lower face or from said upper face.

2. The fastener of claim 1, wherein said first and second cross-members are substantially bilaterally symmetric about a longitudinal central plane disposed parallel to said upper and lower faces.

3. The fastener of claim 2, wherein said convex region of said first cross-member is substantially V-shaped, comprising a first surface extending substantially from the central plane toward said upper face and a second surface extending substantially from the central plane toward said lower face.

4. The fastener of claim 3, wherein said first and second surfaces substantially meet to form an edge capable of engaging a strap threaded between said concave and convex regions.

5. The fastener of claim 3, wherein said first and second surfaces define an included angle of less than about 180 degrees.

6. The fastener of claim 3, wherein said first and second surfaces define an included angle of less than about 120 degrees.

7. The fastener of claim 6, wherein said first and second surfaces define an included angle of about 100 degrees.

8. The fastener of claim 1, wherein said convex region is substantially C-shaped.

9. The fastener of claim 1, wherein said concave region is substantially C-shaped and comprises a rounded surface.

10. The fastener of claim 1, wherein said concave region is substantially C-shaped and comprises a plurality of substantially flat surfaces.

11. The fastener of claim 1, wherein said concave region is substantially V-shaped and comprises a plurality of substantially flat surfaces.

12. The fastener of claim 1, wherein said second cross-member further comprises a flat first surface disposed in the plane of the upper face and a flat second surface disposed in the plane of the lower face, said convex region extending substantially from said first surface to said second surface and substantially abutting said first and second surfaces, said convex region forming edges where it substantially abuts said first and second surfaces, respectively, said edges capable of engaging a strap threaded between said concave and convex regions.

13. The fastener of claim 12, wherein:

said first surface and a plane tangent to said concave surface where said concave surface substantially abuts said first surface define an included angle of less than about 90 degrees; and said second surface and a plane tangent to said concave surface where said concave surface substantially abuts said second surface define an included angle of less than about 90 degrees.

14. The fastener of claim 13, wherein said included angles are about 55 degrees.

15. The fastener of claim 1, wherein:

said convex surface includes a first edge disposed substantially centrally between said upper and lower faces;

said second cross-member has a second edge disposed substantially at the upper extremity of said convex region and a third edge disposed substantially at the lower extremity of said convex region;

said first edge being disposed in opposed relation with respect to said second and third edges on the opposite side of a plane perpendicular to said upper and lower faces and parallel to said cross-members, and said first edge being spaced from said second and third edges along a line perpendicular to the plane a distance not greater than the pre-determined thickness of the strap.

16. The fastener of claim 3, wherein said first cross-member further comprises:

a substantially flat third surface obtusely disposed with respect to said first surface, adjacent thereto, and substantially parallel to said upper and lower faces for guiding and supporting a strap threaded from said bottom face; and a substantially flat fourth surface obtusely disposed with respect to said second surface, adjacent thereto, and substantially parallel to said upper and lower faces, for guiding and supporting a strap threaded from said top face.

17. The fastener of claim 16, wherein said first cross-member further comprises a fifth substantially curved surface that at one edge forms a juncture with said third surface and at the opposite edge forms a juncture with said fourth surface.

18. The fastener of claim 1, wherein said means for securing the strap to the workpiece comprises a third cross-member.

19. The fastener of claim 1, wherein the fastener is a detachable two-piece buckle-type fastener wherein the first piece of said buckle comprises said means for securing the strap to the workpiece and the second piece of said buckle comprises said means for adjustably securing the strap to the fastener.

20. A reversible buckle comprising:

a body having two side members that define an upper face and a lower face;

means for securing the buckle to a workpiece; and means for adjustably securing a strap to the buckle, said adjustably securing means comprising first and second substantially parallel cross-members disposed between and connecting common surfaces of said side members and substantially bilaterally symmetric about a longitudinal central first plane disposed parallel to said upper and lower faces;

said first cross-member having a substantially V-shaped convex region comprising a first surface extending substantially from the first plane toward said upper face and a second surface extending substantially from the first plane toward said lower face, said first and second surfaces substantially meeting to form a first edge substantially at the first plane, capable of engaging a strap threaded between said first and second cross-members, and defining an included angle of about 100 degrees;

said second cross-member having a substantially V-shaped concave region, a substantially flat third surface disposed substantially in the plane of the upper face and a substantially flat fourth surface disposed substantially in the plane of the lower face, said concave region extending substantially from said third surface to said fourth surface and substantially abutting said third and fourth surfaces forming, respectively, second and third edges where they abut said concave region, said second and third edges capable of engaging a strap threaded between said concave and convex regions and defining included angles of about 55 degrees;

said first edge being disposed in opposed relation with respect to said second and third edges on the opposite side of a second plane perpendicular to said upper and lower faces and parallel to said cross-members, and said first edge being spaced from said second and third edges along a line perpendicular to the second plane a distance not greater than the predetermined thickness of the strap;

said oppositely disposed concave and convex regions being capable of cooperatively engaging and adjustably securing a strap threaded therethrough from said lower face of from said upper face.

* * * * *